United States Patent [19]

Asmussen

[11] Patent Number: 4,881,481

[45] Date of Patent: Nov. 21, 1989

[54] TRAVELER CONTROL

[76] Inventor: Hans P. Asmussen, 2620 S. Shore Dr., Milwaukee, Wis. 53207

[21] Appl. No.: 265,045

[22] Filed: Oct. 31, 1988

[51] Int. Cl.[4] ..... B63B 21/24

[52] U.S. Cl. ..... 114/204; 16/87 R; 114/111

[58] Field of Search ..... 114/204, 112, 205, 213, 114/111; 16/87 R; 24/115 R, 115 F, 115 G; 104/249, 250, 251, 252

[56] References Cited

U.S. PATENT DOCUMENTS

| | | | |
|---|---|---|---|
| 3,391,907 | 7/1968 | Vogelsang | 114/204 |
| 4,147,121 | 4/1979 | Fogh et al. | 114/204 |
| 4,651,668 | 3/1987 | Melrose | 114/204 |

*Primary Examiner*—Joseph F. Peters, Jr.
*Assistant Examiner*—Edwin L. Swinehart
*Attorney, Agent, or Firm*—Bayard H. Michael

[57] ABSTRACT

The traveler has a car movable on an athwartship track. The mainsheet is connected to the car. Two oppositely facing hooks are pivotally mounted on the car for similar, simultaneous movement between a latching position and an inoperative position. A spring biases the hooks to latching position. Control lines are connected to each end of a bar which has sliding engagement with the hooks. When a control line is tensioned, the bar moves towards the line and actuates the hooks to inoperative position. When both lines are slack, the hooks are in operative position to engage stop pins positioned on either side of the center of the track.

9 Claims, 2 Drawing Sheets

TRAVELER CONTROL

FIELD OF THE INVENTION

A control for the mainsheet traveler on a sailboat. The control automatically retains the traveler in a windward position upon completion of a tack.

BACKGROUND OF THE INVENTION

High performance sailboats are usually provided with a mainsheet system which is connected to a traveler mounted on the aft deck or on a bridge in the cockpit or on the cabin trunk. The traveler includes a car which rolls along a track. Lines are connected to the car to control its travel and position along the track. In light air the boat will frequently sail better if the car is trimmed to windward of the centerline of the boat. In heavy air the car may be let out considerably to leeward to spill air from the mainsail.

Assuming the car is trimmed to windward, the traveler control line is cleated to hold the car in the desired windward position. When the boat is to be tacked, the car has to be released so that it can travel to the other side of the boat to thereby enable the car to be trimmed to windward after the a tack has been completed. If the control line isn't released the car can't get over to the desired new position.

When tacking a boat things can get pretty busy at the helmsman station and this frequently results in the car ending up in a leeward position at the end of the tack. This is the very time when power and pointing ability are necessary to regain speed and the car should be trimmed to windward. If the helmsman is too concerned with trimming the car to windward, he probably won't be steering the boat very well and in competitive racing this is a serious concern.

There have been efforts in the industry to provide some means of retaining the car in a windward position at the completion of a tack. The solutions thus far offered are not practical and have been withdrawn from the market.

SUMMARY OF THE INVENTION

An object of this invention is to provide a traveler control which will automatically latch the traveler car in a windward position at the end of a tack.

Another object is to provide such a control with means to override the latch to allow the car to be moved along the traveler track without the latch operating.

Still another object is to provide a traveler control with a latch mechanism which will engage a pin when the car moves in one direction and will ride over the pin when the car moves in the other direction.

DETAILED DESCRIPTION OF THE DRAWINGS

Figure 1:
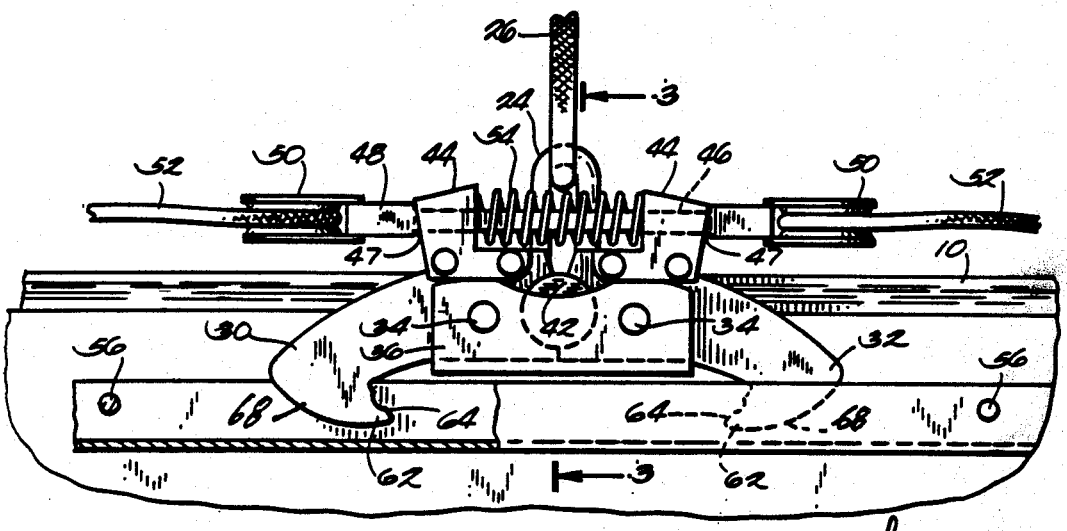
FIG. 1 is a fragmentary elevation of the control with both control lines slack.
Figure 2:
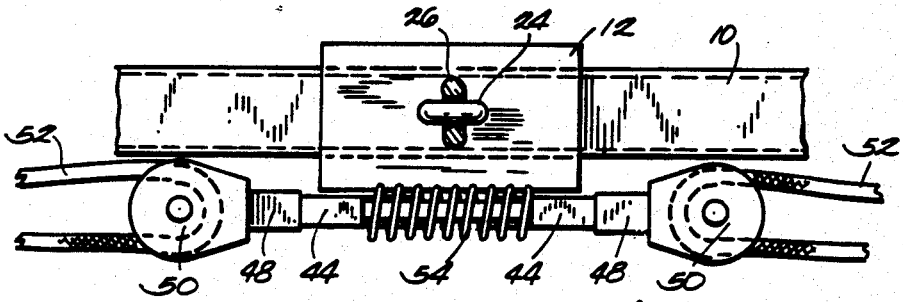
FIG. 2 is a top plan view of FIG. 1.
Figure 3:
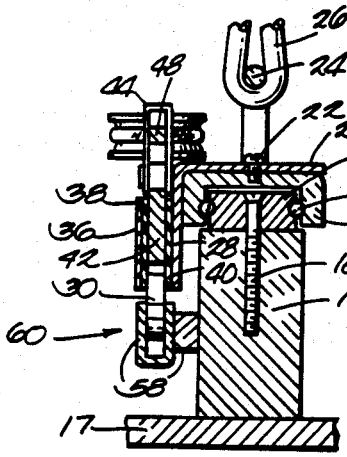
FIG. 3 is a vertical section on line 3—3 in FIG. 1.
Figure 4:
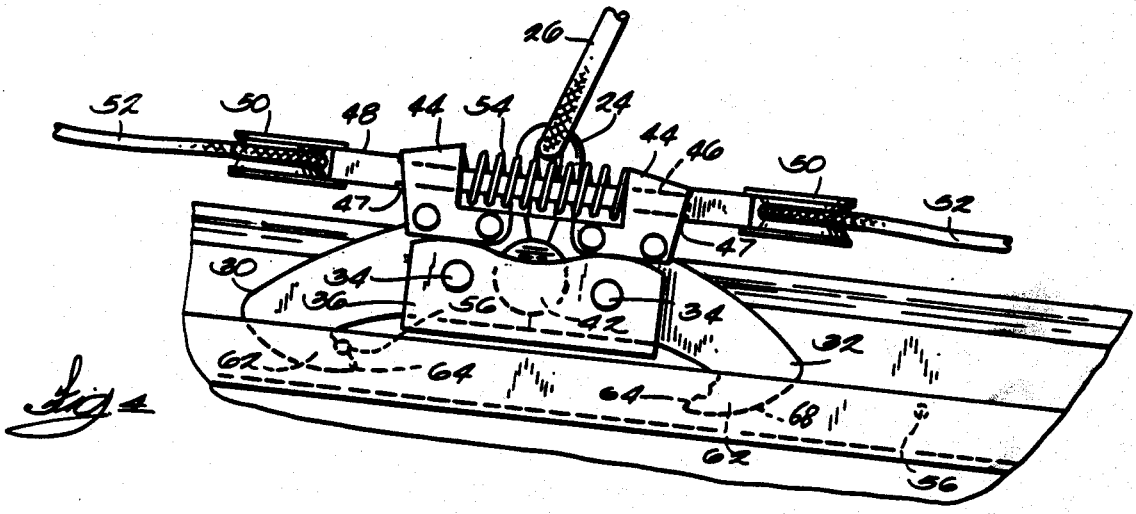
FIG. 4 is similar to FIG. 1 but shows the traveler car hooked or latched to windward.

The present traveler control is adapted to be mounted on the side of a traveler car. The traveler is made up of an aluminum track 10 on which the car 12 slides. Typically, the car 12 will be mounted on a ball bearing arrangement, the present one being designated 14. The track 10 is mounted on a wood block 16, which is mounted athwartship on the deck 17, by screw or bolt 18. The track and block can be one piece. The car is made of aluminum or stainless steel and has a bracket 20 secured thereto by means of screws 22. The mainsheet (rope) 26 is secured to the connector or bail 24 fixed on the car or, in some cases, there will be a block and tackle system secured directly to the bail 24. These details have no bearing on the present invention.

The plate 20 fixed to the car 12 has a depending flange 28. Plate 20/28 can be made integral with the car 12. Latch plates or hooks 30, 32 are pivotally mounted on pivots 34, 34 which pass through cover plate 36 and screw into the flange 28. Nylon (nylon is the generic name for a family of polyamide polymers characterized by the present of the amide group - CONH) or TEFLON ® (trademark for tetrafluoroethylone fluorocarbon polymers) or other suitable bearing material 38, 40 is captured between the plate 36 and the flange 28 with the hooks 30, 32 between the bearings 38, 40.

Figure 5:
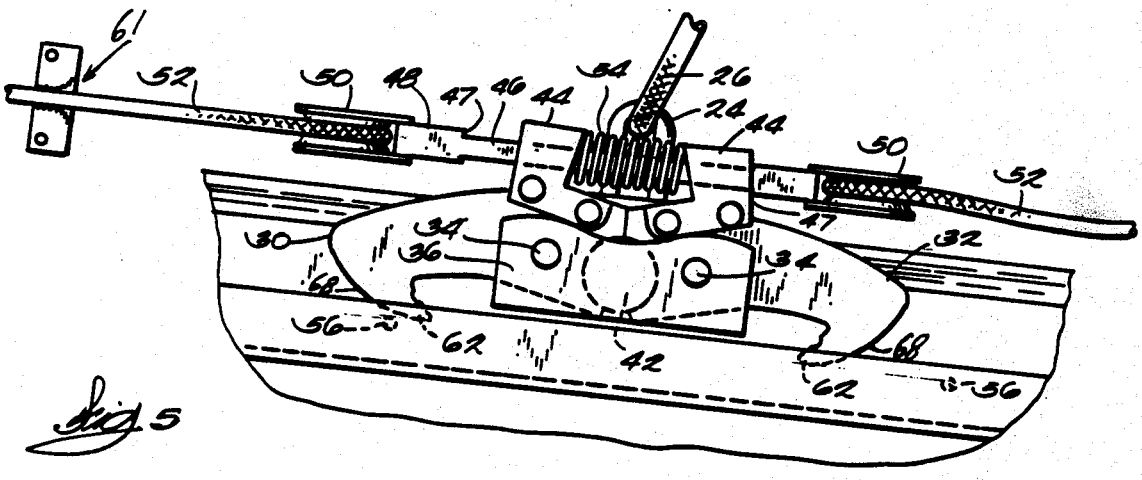
FIG. 5 is similar to FIG. 4 but shows how the hooks are raised when the windward control line is pulled or cleated.
Figure 6:
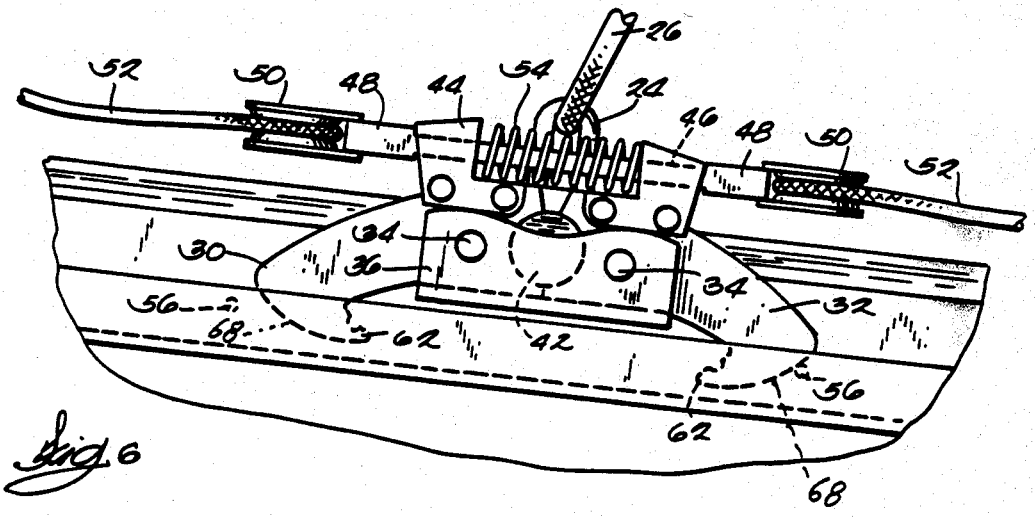
FIG. 6 shows the traveler moving to the right. The right hook is about to be cammed over the right pin.

The hooks 30, 32 have facing hooking surfaces 64, 64 and are interconnected for similar and simultaneous movement by means of a disc 42 fitting in semi-circular cut-outs in the confronting faces of the hooks 30, 32. Thus, the disc works like a gear connecting the two hooks. It will be noted the confronting faces of the hooks 30, 32 are not diametrical relative to the disc. Thus, in the position shown in FIG. 1, there is a gap between the upper ends of the confronting faces and the lower portions of the confronting faces between the disc are in abutting relationship limiting pivotal movement of the hooks. In this position the hooks are down in the latching position. When the hooks are raised to the unlatched position, such as shown in FIG. 5, the upper confronting faces abut to limit movement and there is a gap between the lower confronting faces.

The top portion of each hook is provided with a guide 44. A bar 46 fits through the two straps and each end of the bar outside the straps 44 supports an enlarged member 48 on which a sheave or block 50 is mounted with the wheel horizontally disposed. A traveler control line 52 passes through each block. One end of the traveler control line is fixed while the other end of the line feeds through a cam cleat and rope guide arrangement 61.

As shown in FIG. 1, with both control lines slack, the spring 54 is coiled around bar 46 and is compressed between the two guides 44, acts to pivot each hook about its pivot pin 34. Considering the right side of FIG. 1, that means the hook 32 is pivoted in a clockwise direction while the left hook 32 would be pivoted in a counterclockwise direction because the disc 42 moves counterclockwise about the right pivot 34 and forces the left hook to pivot counterclockwise. This puts both hooks down in operative position to engage either pin 56 mounted to span the space between sides 58, 58 of the secondary track 60. The tips 62 of the hooks always lie inside the spaced sides of this secondary track.

When the boat is on either tack, the boom will move towards the "low side" of the boat and tension the mainsheet 26. If the boat is on starboard tack, the boom will move towards the port side of the boat. This will roll the car to the left (port) in FIG. 1. If the boat is on port tack, the car will move to the right (starboard). The mainsheet exerts a force on the car in a direction parallel to the mainsheet 26 and this has a horizontal component moving the car to the "low end" of the track. If the windward control line 52 is pulled to resist the movement of the car a force is applied to the windward pulley 50 which is connected to the leeward pulley through bar 46. The control line force is in opposition to the force in the mainsheet. The leeward enlarged member 48 on the bar has a shoulder 47 which engages the adjacent guide 44 and moves the guide about its associated pivot 34. This compresses spring 54 and raises the associated hook to an unlatched, inoperative position. Similar and simultaneous movement will be imparted to the other hook through the disc 42. The spring 54 continues to exert force on the guides 44 tending to drive them and the associated hooks back to the operative position as soon as force is removed from the control line. So long as force great enough to compress spring 54 is applied to the control line, the hooks will stay in the unlatched or inoperative position and movement of the car along the entire length of the track is normal. The mainsheet can be "played" by operating the control line. When the car is in a desired position, it can be retained in that position by cleating the control line in the associated cam cleat 61.

When it is desired to tack the boat, the control line 52 is taken out of the cam cleat 62 and, as the boat is tacked, the control line is let off to let spring 54 drive the hooks down to their operative or latching position. The traveler car will now move toward the low side (which is going to be the high side shortly) and, if the car is still windward of the leeward pin 56, the cam surface 68 will lift the hook to let the car pass over the pin 56. As soon as it has passed, the spring 54 will move the hooks back to latching position. When the tack is completed, the car is on the new windward side of the boat and the hooking surface 64 of the hook will engage the pin 56 to latch the car in windward position to ensure driving force from the mainsail. If this position is not the ultimately desired position, the skipper can manually position the car by operating the windward traveler control line 52. But, in the meantime, his sail has been retained in a desirable position.

Multiple holes for reception of the latch pins 56 can be provided along the length of the track and in that case it would be a simple matter to use pins having spring loaded detent balls on the end so that the pin could be rapidly moved from one hole to another to ensure positioning the latch pins at the most desired locations. It will be noted that hook surface 64 which engages the pin 56 is on a radius about pivot 34. This reduces the force required to release the hook from the pin.

The present control gives the helmsman the ability to release the car for movement to the desired position for the next tack immediately prior to tacking or during the tack. Thus, the car is allowed to move to leeward during the tack (the mainsail isn't doing any good at that time anyhow) and, as soon as the tack is completed, the car is latched or hooked to windward and the mainsail is in position to power the boat. Another important feature of the invention is that any time that the skipper wishes to take over control of the traveler position, all he does is operate the traveler control line in a normal way. So long as there is enough force applied to the traveler control line to compress the spring 54 the hooks are kept out of latching position.

Considering the operation of this control starting with the car latched in windward position; the control line 52 is slack. If it is desired to "play" the mainsheet via the traveler, the windward control line 52 is tensioned to pull the car slightly to windward at which point the compressed spring 54 will move the hooks to the raised position in which position they clear the stop pins 56 and the car can be moved along the entire length of the track in a normal manner. The car can be held in any position simply by cleating the windward control line 52.

When the boat is to be tacked, the control line 52 is released while the boat is on the original tack. This lets the car move leeward to the end of the track as the boat is tacked. The hooks are in the down position. After the tack the boom and car move leeward. The windward hook engages the windward stop pin 56 and the car is trimmed to windward. Without this control, the car would travel to the most leeward position and the boat would lose considerable speed until the car was hauled back to windward via a control line or equivalent. With this control it is possible to tack and be certain the mainsheet will be properly trimmed at the completion of the tack. When things settle down, the windward control line can be tensioned to release the hook and enable the car to be positioned with greater precision. When the windward control line is cleated the force on the mainsheet pulling the car to leeward generates enough force to compress the spring 54 to raise the hooks and keep them clear of the pins.

I claim:

1. A traveler control for the mainsheet on a sailboat, comprising, an elongated athwartship track having a center midway between the ends of the track, a car mounted on said track for movement athwartship and having a connector to which a mainsheet is connected, a pair of opposed hooks each of which is mounted on said car for movement between an operative position and an inoperative position, and a fixed stop pin mounted on said track on each side of the center of said track, each hook including a hooking surface operative to engage a stop pin as the car moves from either end of said track towards the center of the track with said hook in its operative position.

2. A traveler control according to claim 1, including, means biasing said hooks to said operative position, control means connected to said car and operative to control movement of the car along said track in opposition to the pull of the mainsheet on said car, and means responsive to operation of said control means to move said hooks to their said inoperative positions.

3. A traveler control according to claim 2 including means interconnecting said hooks for simultaneous movement between their said operative and inoperative positions.

4. A traveler control according to claim 3 in which each hook includes a cam surface facing away from the center of said car and operative to move said hook to said inoperative position upon engagement with a stop pin as said car moves from said center.

5. A traveler control according to claim 4 in which said hooks are pivotally mounted on said car and each has a guide aligned with the guide on the other, and including, a bar mounted in said guides, said biasing means comprising a spring coiled around said bar and compressed between said guides, an enlarged member on each end of said bar operative to engage the adjacent guide to move the associated hook to inoperative position, said control means including a separate control connected to each said enlarged member.

6. A traveler control according to claim 5 in which said hooks have confronting, engaging faces each having a generally semi-circular opening, said interconnecting means comprising a disc fitting in said semi-circular openings.

7. A traveler control according to claim 3 including a secondary track mounted adjacent the first named track and having spaced plates, said hooks fitting between and being guided by said spaced plates in both of said hook positions.

8. A traveler control for the mainsheet on a sailboat, comprising, an elongated track having a center midway between the ends of the track, a car mounted on said track and including a connector to which a mainsheet is connected, a pair of hooks pivotally mounted on said car for movement between a latching position and an inoperative position, means biasing said hooks to said latching position, a fixed pin on each side of the center of the track and in position to be engaged by one of said hooks when said one hook is in its latching position, control means operative to control movement of said car along said track, and means for moving said hooks to said inoperative position in response to operation of said control means.

9. A traveler control according to claim 8 in which each hook has a cam surface for raising the hook to pass a pin when said car moves in one direction.

* * * * *